US005570678A

United States Patent [19]

Waggoner et al.

[11] Patent Number: 5,570,678

[45] Date of Patent: Nov. 5, 1996

[54] CEMENT SIDING SHEARING TOOL

[75] Inventors: Kurt Waggoner; Lloyd Fladgard; Scott Fladgard, all of Kingston; Joseph Gaidjurges, Renton; John Whitehead, Sumner, all of Wash.

[73] Assignee: Pacific International Tool & Shear, Ltd., Kingston, Wash.

[21] Appl. No.: 351,599

[22] Filed: Dec. 7, 1994

[51] Int. Cl.[6] ..... B28D 1/32

[52] U.S. Cl. ..... 125/23.01; 83/624; 83/626; 125/16.01; 125/16.03

[58] Field of Search ..... 125/23.01, 16.03, 125/40; 83/624, 626

[56] References Cited

U.S. PATENT DOCUMENTS

| | | | |
|---|---|---|---|
| 1,814,151 | 7/1931 | Gundlach . | |
| 1,981,695 | 11/1934 | Gundlach | 164/44 |
| 2,808,822 | 10/1957 | Celapino | 125/23.01 |
| 3,297,015 | 1/1967 | Crawford | 125/23.01 |
| 3,524,374 | 8/1970 | Diolot | 83/626 |
| 3,677,258 | 7/1972 | Fletcher et al. . | |
| 3,727,600 | 4/1973 | Schlough | 125/23.01 |

FOREIGN PATENT DOCUMENTS

| | | | |
|---|---|---|---|
| 0048610 | 2/1919 | Denmark | 125/16.03 |
| 0745605 | 7/1980 | U.S.S.R. | 83/624 |

*Primary Examiner*—D. S. Meislin
*Assistant Examiner*—Dona C. Edwards
*Attorney, Agent, or Firm*—Seed and Berry LLP

[57] ABSTRACT

A shearing tool for cutting cement siding which includes upper and lower blade holders. Each blade holder has first and second ends and an elongated slot extending substantially therebetween. The blade holders are positioned so that the slots face each other and are substantially aligned. Upper and lower blades are removably mounted in the slots of the upper and lower blade holders, respectively. The upper and lower blades each have a relatively narrow cross-sectional width and a cutting edge. When positioned in the slots of the blade holders, the upper and lower blades define a cutting plane in which the cutting edges are substantially aligned and face each other. A number of links are operatively connected to the ends of the blade holders so that either the upper or lower blade holder can move towards the other in the cutting plane. The links are configured so that the cutting edges of the blades are substantially parallel upon engaging a cement siding workpiece in a closed position, and an actuator is connected to at least one of the links for moving either the upper or lower blade holders towards the other to engage the upper and lower blades with the siding in the closed position.

7 Claims, 5 Drawing Sheets

CEMENT SIDING SHEARING TOOL

The present invention relates to a shearing tool for cutting cement siding used in construction.

BACKGROUND

Many different siding materials, including wood, concrete, brick, aluminum, stucco, wood composite and cement are currently available for covering the exterior of buildings. Although wood is one of the most popular siding materials, it is costly, flammable, subject to expanding/contracting and comes from a constantly diminishing resource. Aluminum is also a popular siding material, but it is costly, subject to expanding/contracting and is easily deformed. Brick and stucco are somewhat less popular siding materials, but they, too, are costly and labor-intensive to install. On the other hand, cement siding is non-flammable, weather-proof, and not subject to rotting or infestation because it is made from cement, silica sand and cellulose. Thus, it is highly desirable to use cement siding to cover the exterior of buildings.

Although cement siding has many positive characteristics, and it has been available for use as a siding material since before 1900, it has enjoyed only relatively modest success because it is expensive and difficult to cut. Cement siding is generally cut either by using a saw with an abrasive wheel, or by scoring it with a device having a carbide tip and then snapping it along the score line in a manner similar to a tile cutter.

Cutting cement siding using a saw generates large amounts of dust which is inconvenient and creates an unpleasant work environment. Cutting cement siding with a saw is also economically inefficient because it is time-consuming and the saw blades wear out quickly. Cutting cement siding by scoring it with a carbide tip and then snapping it along the score line is also time-consuming and does not result in a clean, sharp edge along the cut. Therefore, in light of the positive characteristics of cement siding, it would be desirable to develop a tool for cutting cement siding that is quick, significantly reduces the amount of dust and creates a clean, sharp edge along the cut.

SUMMARY OF THE INVENTION

The invention is a shearing tool for cutting cement siding which includes upper and lower blade holders. Each blade holder has first and second ends and an elongated slot extending substantially therebetween. The blade holders are positioned so that the slots face each other and are substantially aligned. Upper and lower blades are removably mounted in the slots of the upper and lower blade holders, respectively. The upper and lower blades each have a relatively narrow cross-sectional width and a cutting edge. When positioned in the slots of the blade holders, the upper and lower blades define a cutting plane in which the cutting edges are substantially aligned and face each other. A number of links are operatively connected to the ends of the blade holders so that either the upper or lower blade holder can move towards the other in the cutting plane. The links are configured so that the cutting edges of the blades are substantially parallel upon engaging a cement siding workpiece in a closed position. An actuator is connected to at least one of the links for moving either the upper or lower blade holders towards the other, thereby engaging the upper and lower blades with the siding in the closed position.

The shearing tool of the invention quickly creates a clean, straight cut in cement siding without producing any noticeable dust. As such, the shearing tool of the invention is convenient to use, economically efficient and produces significantly less dust than current cutting devices and methods.

DETAILED OF DESCRIPTION OF THE PREFERRED EMBODIMENT

Figure 1:
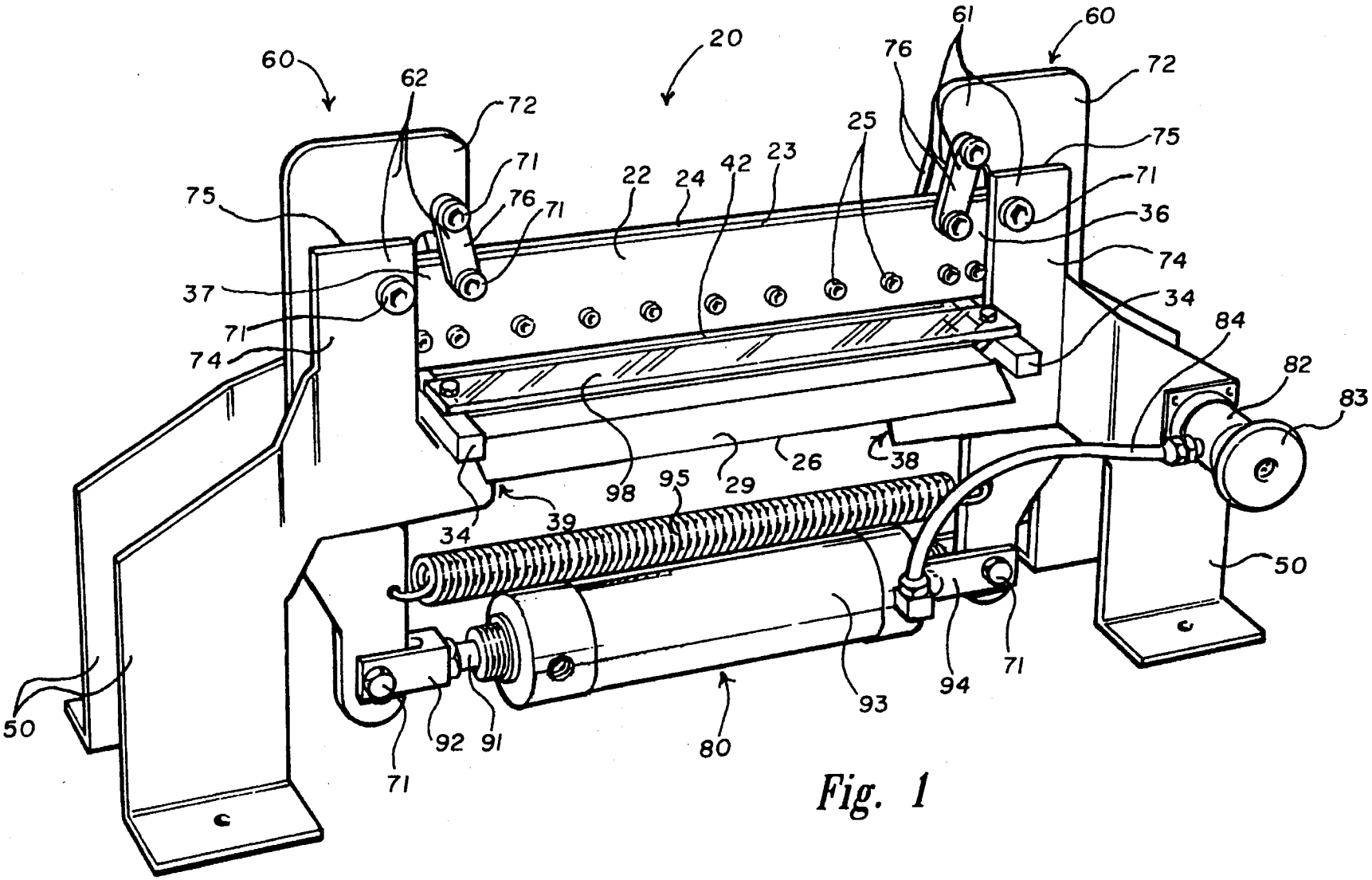
FIG. 1 is a perspective view of a shearing tool in accordance with the invention.

FIGS. 1–4 show a preferred embodiment of the shearing tool 20 for use in cutting cement siding used on the exterior surfaces of buildings. Cement siding, such as HardiPlank®, is made from cement, ground silica sand, cellulose fiber, water and other additives.

The shearing tool 20 includes an upper blade holder 22 in which an upper blade 42 is mounted, and a lower blade holder 26 in which a lower blade 46 is mounted. The upper blade holder 22 is carried by a number of links 60 that are connected to an actuator 80, and the lower blade holder 26 is carried by a base 50.

Figure 4:
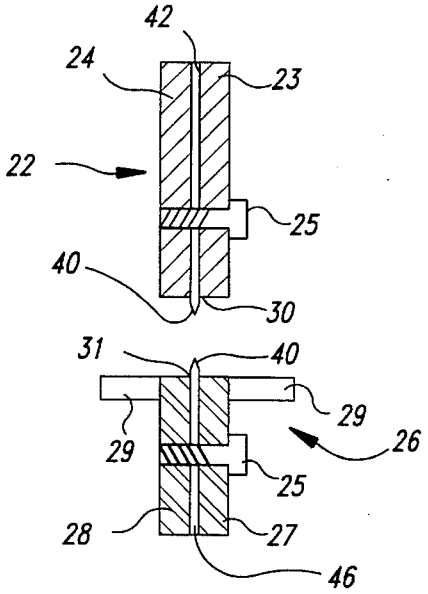
FIG. 4 is a cross-sectional view of a portion of the shearing tool of FIG. 1.

FIG. 4 shows the upper and lower blade holders in greater detail. The upper blade holder 22 includes a front plate 23, a rear plate 24 and a slot 30 therebetween. The upper blade 42 is mounted in the slot 30 of the upper blade holder 22 by a plurality of bolts 25 that pass through the front plate 23 and upper blade 42 to threadedly engage the rear plate 24. The lower holder 26 includes a front plate 27, a rear plate 28 and a slot 31 therebetween. The lower blade 46 is mounted in the slot 31 of the lower holder 26 by a plurality of bolts 25 which pass through the front plate 27 and lower blade 46 to threadedly engage the rear plate 28. The blades may be removed from the holders by disengaging the bolts 25 from the rear plates so that the blades and the front plates may be separated from the rear plates. A sharp blade may then be changed for one which has become dull or damaged.

Figure 5:
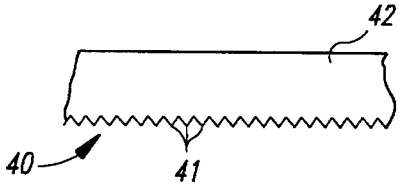
FIG. 5 is a front elevational view of a blade of the invention.

Referring to FIGS. 4 and 5, the upper and lower blades 42, 46 have a relatively narrow cross-sectional width and a cutting edge 40. The maximum cross-sectional width of the blades is approximately between 0.005 inches and 0.20 inches, and is preferably between 0.020 inches and 0.080 inches. The upper and lower blades 42, 46 are positioned so that the cutting edges 40 are substantially aligned and face one another; and when so positioned, the upper and lower blades define a cutting plane along which at least one of the blades is moved so that the cutting edges of the blades can engage a workpiece of cement siding 10 in a closed shearing position. In a preferred embodiment, the cutting edge 40 is serrated with a plurality of teeth 41 as shown in FIG. 5.

Figure 2:
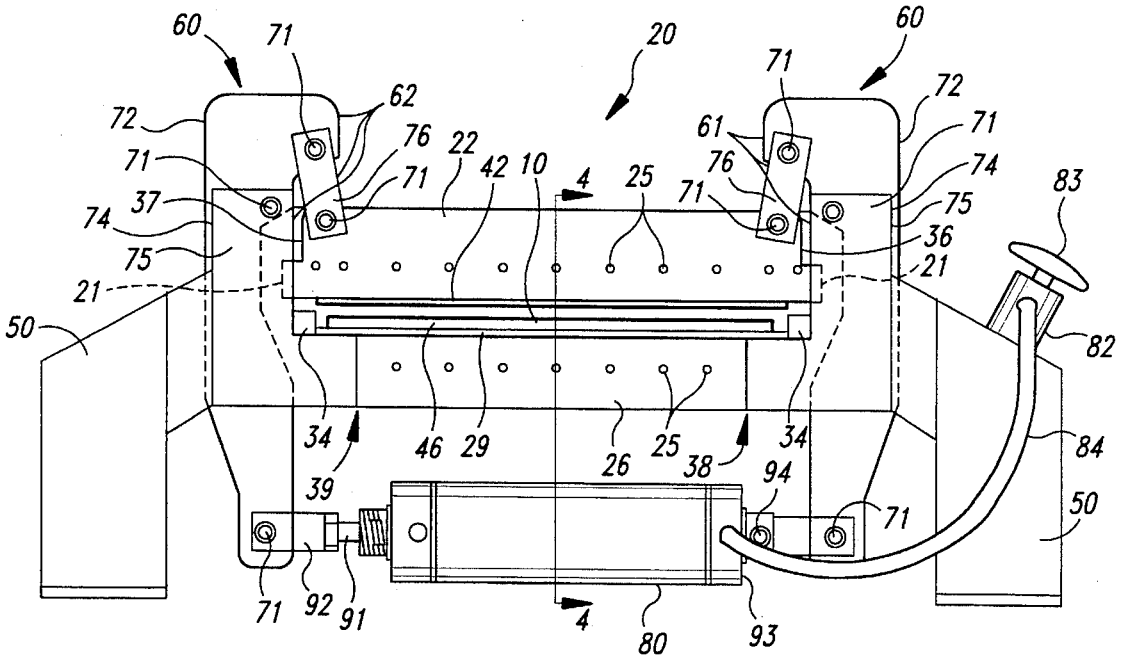
FIG. 2 is a front elevational view of the shearing tool of FIG. 1.
Figure 3:
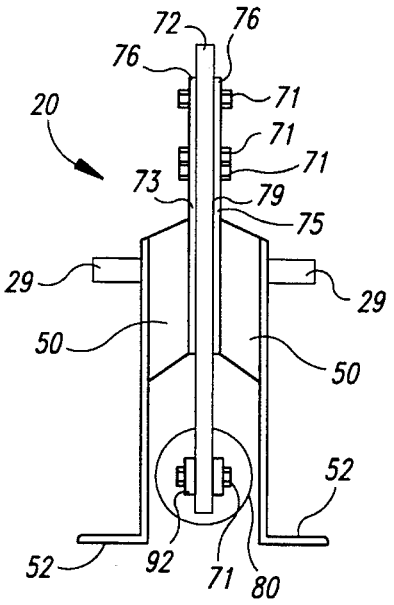
FIG. 3 is a side elevational view of the shearing tool of FIG. 1.

Referring to FIGS. 2 and 3, the lower blade holder 26 is attached to a base 50 at its first end 38 and its second end 39. A shelf 29 for supporting a piece of cement siding 10 after it has been cut may extend outwardly from the top of the lower supports 26 and be positioned below the cutting edge 40 of the lower blade 46. The shelf 29 is preferably a horizontal flange extending outwardly from the top of the front and back plates 27, 28 of the lower support 26 as shown in FIGS. 1 and 4.

FIGS. 1–3 depict the links 60, which include a first link assembly 61 and a second link assembly 62. The first link assembly 61 is connected to the first end 36 of the upper blade holder 22 and the first end 38 of the lower blade holder 26, and the second link assembly 62 is connected to the second end 37 of the upper blade holder 22 and the second end 39 of the lower blade holder 26. The first and second link assemblies 61, 62 each include a bracket 74 which is extends upwardly from either the lower holder 26 or the base 50. In a preferred embodiment, the brackets 74 are formed integrally with the base 50, and as best shown in FIG. 2, each bracket 74 includes two upwardly extending flanges 73, 75 which define a channel 79 therebetween. The first and second link assemblies also each include a lever 72 which is positioned in the channel 79 and pivotally connected to the upper end of the bracket 74 by a bolt 71. The lower end of the lever 72 of the first link assembly 61 is pivotally connected to a flange 94 extending out from the end of the cylinder housing 93 of a mechanically operated actuator 80. Similarly, the lower end of the lever 72 of the second link assembly 62 is connected to a bracket 92 attached to the piston rod 91 of the actuator 80. The first and second link assemblies also each include a coupling 76 attached to the upper end of the lever 72 and the upper holder 22. As best shown in FIG. 1, the coupling 76 may include two arms, wherein one arm is attached to each side of the lever 72 to uniformly transfer the motion of the lever 72 to the upper holder 22.

The actuator 80 is preferably a pneumatic cylinder having a housing 93 and a piston rod 91. Pressurized air is supplied to the actuator through a hose 84, which is connected to the outlet of a valve 82 and the cylinder housing 93. Other mechanically operated actuators, such as hydraulic cylinders or electrically driven rods, may be used either instead of or in conjunction with the pneumatic cylinder 80 shown in FIG. 1.

This invention also is not limited to the link assembly disclosed in FIGS. 1–4, and may include other link assemblies having a different combination of levers, couplings, rods, yokes and cams. The link assemblies of the invention preferably distribute the forces substantially equally along the length of the cutting edges of the upper and lower blades when the blades contact the cement siding workpiece. The link assemblies may be designed to minimize the number of actuators, or the number and positioning of the actuators may be designed to reduce the complexity of the link assemblies. Accordingly, it will be appreciated that more than one actuator may be used to drive the blades towards one another.

The shearing tool 20 operates by first placing a workpiece of cement siding 10 between the cutting edges 40 of the upper and lower blades 42, 46 so that the workpiece 10 rests on top of the lower blade 46. The upper blade holder 22 and upper blade 42 are moved downwardly by depressing the plunger 83 so that pressurized air passes through the hose 84 into the actuator 80. As the pressurized air drives the piston rod 91 out of the housing 93, the length of the actuator 80 is increased. The force of the actuator 80 is equally transmitted to the levers 72, causing the levers 72 to simultaneously pivot about the bolt 71 in the upper portion of the bracket 74. As the levers 72 pivot about the bolts 71, the couplings 76 move the upper blade holder 22 towards the lower holder 46. A flange 21 on each end of the upper blade holder 22 travels in the channels 79 of the brackets 74 to maintain the upper holder 22 in the cutting plane as it moves towards the lower holder 46. Pressurized air is continuously supplied to the actuator 80 until the upper blade 42 contacts the workpiece 10 and causes the upper and lower blades 42, 46 to shear the workpiece along the cutting plane. A number of stops 34 may be positioned on either end of the lower blade holder 27 to prevent the upper blade 42 from contacting the lower blade 46 once the workpiece 10 has been sheared; and a transparent guard 98 extending along the length of the blades is preferably attached to the stops 34. After the workpiece 10 has been sheared, the plunger 83 is released to terminate the air supply to the actuator 80, and the upper blade holder 22 is raised into the open position by a tension spring 95 attached to the lower portion of both of the levers 72 just above the actuator 80.

Figure 6:
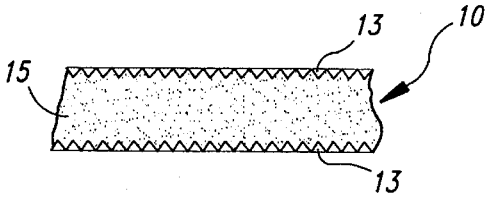
FIG. 6 is a cross-sectional view of a piece of cement siding which has been cut by a shearing tool of the invention.

FIG. 6 shows a workpiece 10 that has been cut by the shearing tool 20. The zonation of the workpiece 10 includes two penetration zones 13 into which the teeth 4 1 of the blades have penetrated, and a fracture zone 15. The penetration zones 13 are actually small crocks that are created by the upper and lower blades 42, 46 as they move towards each other through the workpiece 10. The energy supplied by the pressurized air is focused in the cutting plane through the fracture zone 15, and as the size of the pressure zones 13 approach the critical crack length for the cement siding, a sudden fracture occurs through the fracture zone 15 in the cutting plane.

Central to the understanding of the invention is the importance of enhancing the directional integrity of the crack as it propagates through the cement siding because the directional integrity of the crack greatly affects the quality of the cut. The shearing tool 20 creates a clean, sharp cut by distributing the force generated by the actuator substantially equally along the length of the cutting edges on both sides of the workpiece. Through the operation of the actuator 80 and the links 60, the shearing tool provides such an equal force by positioning the upper and lower blades 42, 46 so that they are substantially parallel to each other when the blades contact the workpiece in the penetration zones. The shearing tool 20 automatically positions the blades as such regardless of the thickness of the workpiece in most instances, which greatly reduces the set-up time for cutting cement sidings of different thicknesses at a job site. The shearing tool also creates a clean, sharp cut by providing blades with a small cross-sectional width and serrated teeth. The narrow width and serrated teeth allow the blades to better penetrate the cement siding and focus the force supplied by the actuator in a well defined plane. Accordingly, the shearing tool of the invention greatly enhances the directional integrity of the crack as it propagates through the fracture zone 15.

FIGS. 7–11 depict another embodiment of the invention in which a shearing tool 120 is manually operated. The shearing tool 120 includes upper and lower blade holders 122, 126, respectively. The upper blade holder 122 has a front plate 123, a back plate 124 and a slot 130 therebetween. An upper blade 142 is mounted in the slot 130 by a number of bolts 125 which pass through the front plate 123 and upper blade 142 to threadedly engage the back plate 124. The lower support 126 includes a front plate 127, a back plate 128 and a slot 131 therebetween. The lower blade 146 is mounted to the lower blade holder 126 in the slot 131 by a number of bolts 125 that pass through the front plate 127 and lower blade 146 to threadedly engage the back plate 128. A transparent guard 198 is preferably attached to the upper blade holder 122.

Figure 11:
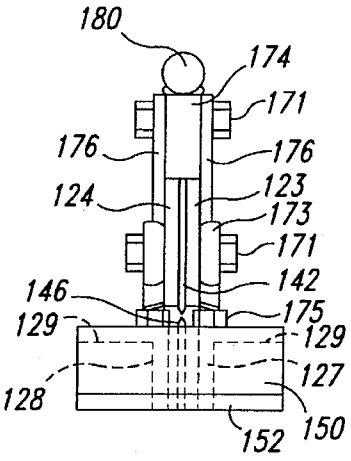
FIG. 11 is a side elevational view of the shearing tool of FIG. 10.

The upper holder 122 is mounted onto the lower holder 126 by a number of links 160. The links 160 include a first link assembly 161 that is operatively connected to the first end 136 of the upper blade holder 122 and the first end 138 of the lower blade holder 126. The first link assembly 161 has an eye bolt 173 that is vertically adjustable with respect to the lower blade holder 126 by two nuts 175 that threadedly engage the threaded stem of the eye bolt 173 on either side of the support shelf 129. The upper blade holder 122 is pivotally mounted to the eye bolt 173 on a pin 171 that extends through the upper blade holder 122 and the opening of the eye bolt 173. Two eye bolts 173, one positioned on each side of the upper blade holder 122, are preferably used to provide more support for the upper blade holder 122 as shown in FIG. 11.

Figure 7:
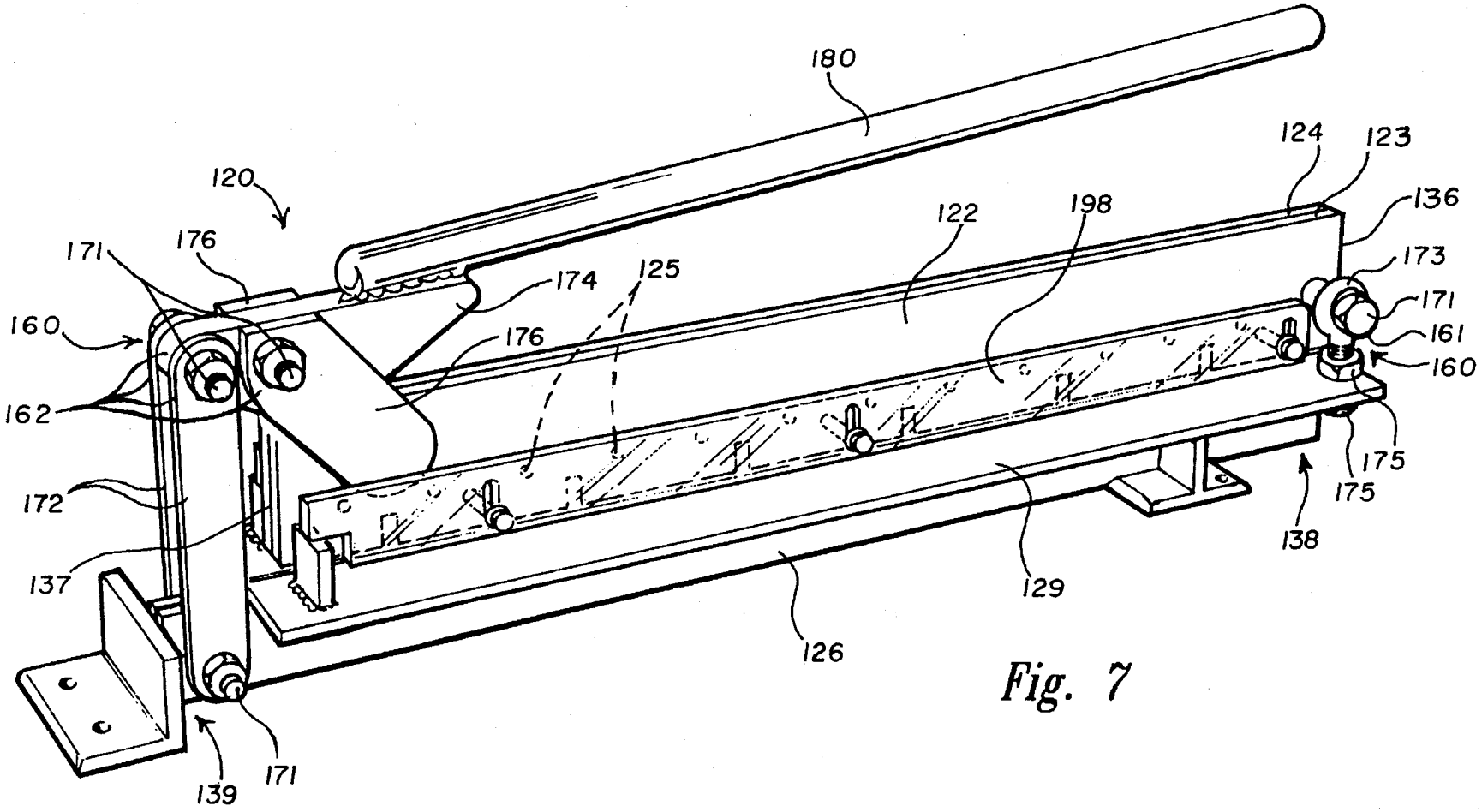
FIG. 7 is a perspective view of another shearing tool in accordance with the invention in the open position.
Figure 9:
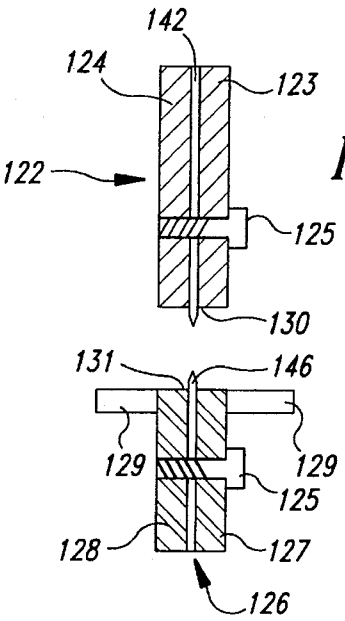
FIG. 9 is a cross-sectional view of the shearing tool of FIG. 7.

The links 160 further include a second link assembly 162 that is connected to the second end 137 of the upper blade holder 122 and the second end 139 of the lower blade holder 126. The second link assembly 162 includes a rod 172 that is pivotally connected to the lower blade support 126 at one end and a yoke 174 at its other end. The second link assembly 162 also includes a coupling 176 that is pivotally connected to the yoke 174 and the upper blade holder 122. The rod 172 and coupling 176 may each include two separate members as shown in FIG. 7. A lever 180 is fixedly attached to the top of the yoke 174.

Figure 8:
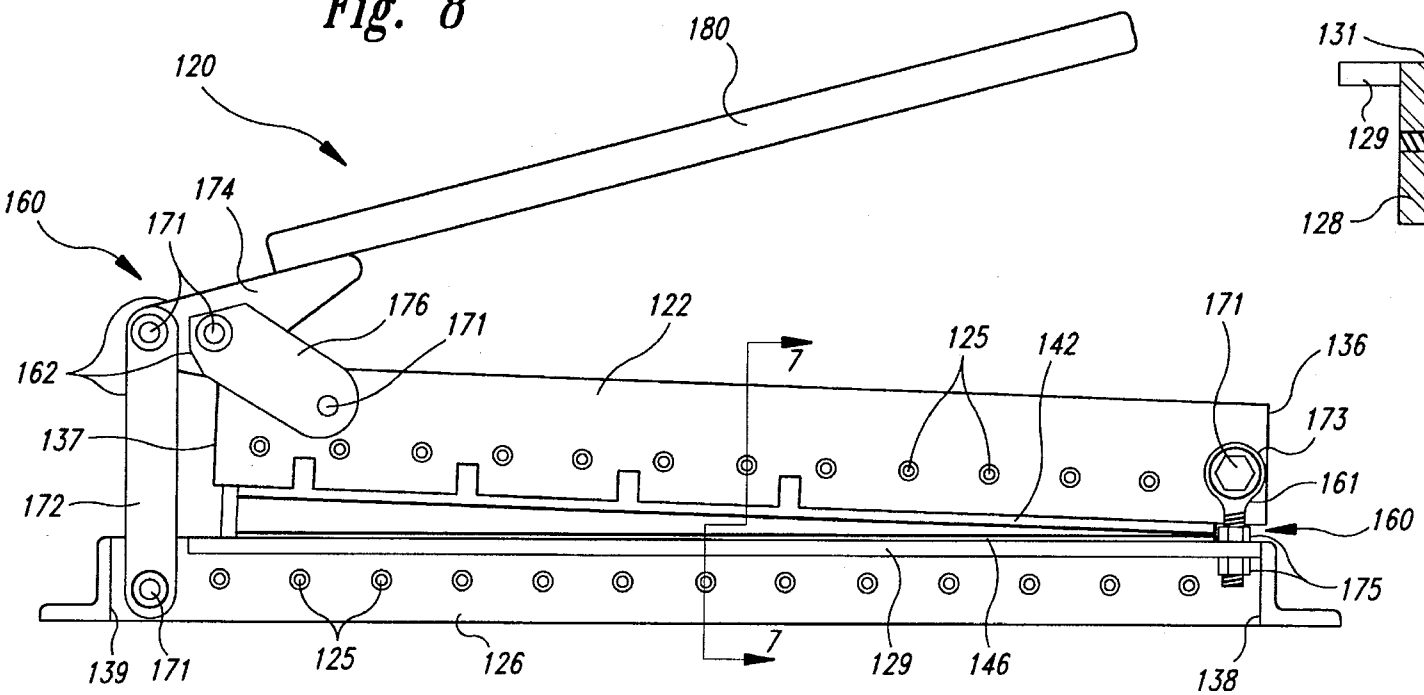
FIG. 8 is a front elevational view of the shearing tool of FIG. 7.
Figure 10:
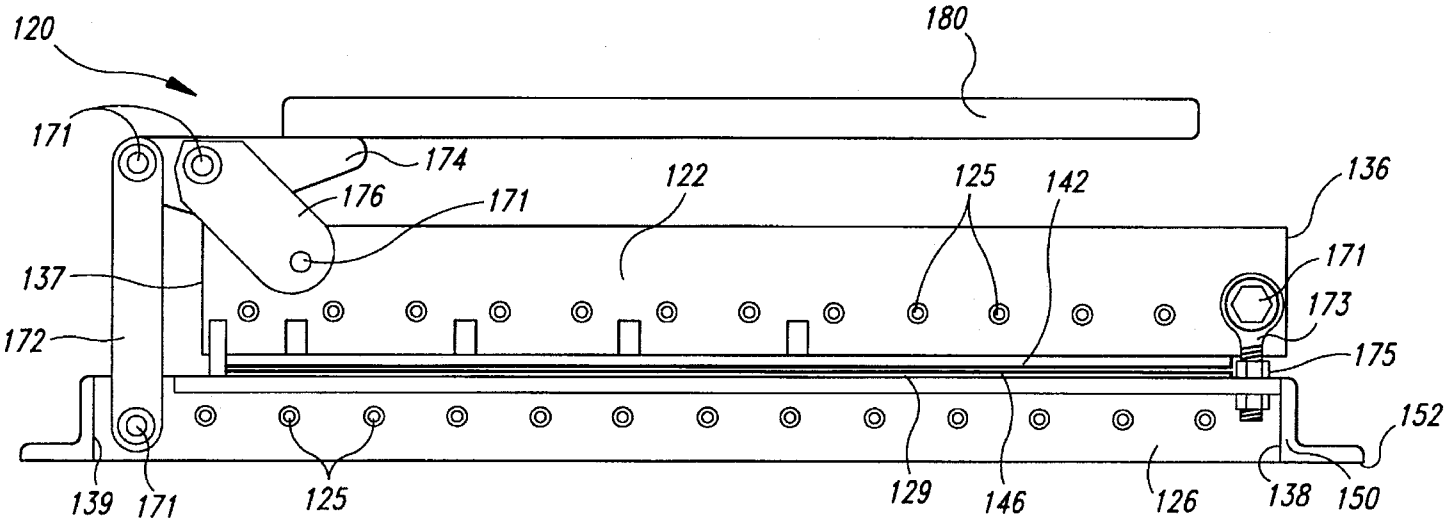
FIG. 10 is a front elevational view of the shearing tool of FIG. 7 in the closed siding cutting position.

The operation of the shearing tool 120 is best shown in FIGS. 8 and 10. In Figure 8, the lever 180 and the upper blade holder 122 are shown in the raised position in which a piece of cement siding may be positioned between the upper and lower blades 142, 146. As the lever 180 is moved into the closed siding cutting position shown in FIG. 8, the force of the lever is transferred through the second link assembly 162 to the second end 137 of the upper blade holder 122, causing the upper blade holder 122 to pivot about the pin 171 extending through the eye bolt 173. As shown in FIG. 10, the upper and lower blades 142, 146 are substantially parallel to each other when the upper blade holder 122 is in the closed siding cutting position. In order to accommodate for different thicknesses of cement siding, the second link assembly may be vertically adjusted by rotating the nuts 175 about the threads in the stem of the eye bolt 173. The upper blade holder 122 is returned into the open position after the cement siding has been cut by manually lifting the lever 180 into the raised position.

While a preferred embodiment of the present invention has been described, it should be understood that various changes, adaptations and modifications may be made therein without departing from the spirit of the invention and the scope of the appended claims.

What is claimed is:

1. A shear for cutting cement siding, comprising:

upper and lower blade holders each having first and second ends and an elongated slot extending substantially therebetween, the holders being positioned so that the slots are substantially aligned and facing each other;

upper and lower blades each having a cutting edge, the upper and lower blades being removably mounted in the slots of the upper and lower holders, respectively, and positioned in a cutting plane wherein the cutting edges face one another and are substantially aligned;

a mechanically operated actuator having a cylinder, the cylinder having a piston rod and a housing; and links operatively connecting the first ends of the holders together and the second ends of the holders together, the links being positionable so that the cutting edges of the blades are substantially parallel upon engaging the siding, the links including a first link assembly connected to the first ends of the holders and a second link assembly connected to the second ends of the holders, the link assemblies each having a bracket attached to the lower holder and extending upwardly therefrom, a lever with an upper end pivotally connected to the bracket and a lower end pivotally connected to the actuator, and a coupling with an upper end pivotally connected to the upper end of the lever and a lower end pivotally connected to the upper holder, the lower end of the lever of the first link assembly being attached to the housing of the cylinder and the lower end of the lever of the second link assembly being attached to the piston rod of the cylinder, the actuator acting in conjunction with the first and second link assemblies to move the upper holder towards the lower holder into the closed siding cutting position as the piston rod moves out of the cylinder housing.

2. The shear of claim 1, wherein the actuator is a pneumatic cylinder.

3. The shear of claim 1, wherein the actuator is a hydraulic cylinder.

4. The shear of claim 1, further comprising a stop positioned between the upper and lower holders for controlling the distance between the cutting edges in the closed siding cutting position.

5. A shear for cutting cement siding, comprising:

upper and lower blade holders each having first and second ends and an elongated slot extending substantially therebetween, the holders being positioned so that the slots are substantially aligned and facing each other;

upper and lower blades each having a serrated cutting edge, the upper and lower blades being removably mounted in the slots of the upper and lower holders, respectively, and positioned in a cutting plane wherein the cutting edges face one another and are substantially aligned;

a mechanically operated actuator having a cylinder, the cylinder having a piston rod and a housing; and links operatively connecting the first ends of the holders together and the second ends of the holders together, the links being positionable so that the cutting edges of the blades are substantially parallel upon engaging the siding, the links including a first link assembly connected to the first ends of the holders and a second link assembly connected to the second ends of the holders, the link assemblies each having a bracket attached to the lower holder and extending upwardly therefrom, a lever with an upper end pivotally connected to the bracket and a lower end pivotally connected to the actuator, and a coupling with an upper end pivotally connected to the upper end of the lever and a lower end pivotally connected to the upper holder, the lower end of the lever of the first link assembly being attached to the housing of the cylinder and the lower end of the lever of the second link assembly being attached to the piston rod of the cylinder, the actuator acting in conjunction with the first and second link assemblies to move the upper holder towards the lower holder into the closed siding cutting position as the piston rod moves out of the cylinder housing.

6. The shear of claim 5, wherein the actuator is a pneumatic cylinder.

7. A shear for cutting cement siding, comprising:

upper and lower blade holders each having first and second ends and an elongated slot extending substantially therebetween, the holders being positioned so that the slots are substantially aligned and facing each other;

upper and lower blades each having a serrated cutting edge and a cross-sectional width between 0.0156 inches and 0.125 inches, the upper and lower blades being removably mounted in the slots of the upper and lower holders, respectively, and positioned in a cutting plane wherein the cutting edges face one another and are substantially aligned;

a first link assembly connected to the first ends of the holders and a second link assembly connected to the second ends of the holders, the link assemblies each having a bracket attached to the lower holder and extending upwardly therefrom, a lever pivotally connected to the bracket, and a coupling with an upper end pivotally connected to the lever and a lower end pivotally connected to the upper holder, the first and second link assemblies being operatively connected the first and second ends of the holders, respectively, so that at least one of the holders can move towards the other holder in the cutting plane with the cutting edges of the blades being substantially parallel upon engaging the siding;

a stop positioned between the upper and lower holders for controlling the distance between the cutting edges;

a pneumatic cylinder having a housing and a piston rod, the housing being connected to the lever of one of the first and second link assemblies and the piston rod being connected to the lever of the other of the first and second link assemblies, the cylinder being extensible between a retracted position and an extended position whereby the first and second link assemblies move the at least one of the upper and lower holders towards the other into a closed position; and a spring positioned between the levers of the first and second link assemblies for returning the at least one of the upper and lower blade holders into an open position.

* * * * *